US005154806A

United States Patent [19]

Prevost

[11] Patent Number: 5,154,806

[45] Date of Patent: Oct. 13, 1992

[54] PROCESS FOR REDUCING ENERGY REQUIREMENTS IN THE ELECTROLYTIC PRODUCTION OF CHLORINE AND SODIUM HYDROXIDE

[75] Inventor: Ronald J. Prevost, St. Gabriel, La.

[73] Assignee: Pioneer Chlor Alkali Co., Inc., Houston, Tex.

[21] Appl. No.: 759,871

[22] Filed: Sep. 13, 1991

[51] Int. Cl.[5] ..... C25B 15/00; C25B 1/16

[52] U.S. Cl. ..... 204/99; 204/128; 204/129

[58] Field of Search ..... 204/96, 99, 128, 129

[56] References Cited

U.S. PATENT DOCUMENTS 4,038,365 7/1977 Patil et al. ..... 204/128

4,753,814 6/1988 Gilmore ..... 426/533

*Primary Examiner*—John Niebling

*Assistant Examiner*—Kathryn Gorgos

*Attorney, Agent, or Firm*—Gunn, Lee & Miller

[57] ABSTRACT

A mercury cell is one method to make gas chlorine and sodium hydroxide from a sodium chloride feed. Cell operating voltage is lowered by adding a small amount of a polar polymer to the feed. The preferred additive is water soluble is polyacrylic acid in a range of up to about 10 ppm, preferably about 0.5 to about 1.0 ppm.

8 Claims, No Drawings

PROCESS FOR REDUCING ENERGY REQUIREMENTS IN THE ELECTROLYTIC PRODUCTION OF CHLORINE AND SODIUM HYDROXIDE

BACKGROUND OF THE DISCLOSURE

Chlorine gas and sodium hydroxide are jointly manufactured almost exclusively by the electrochemical reduction of salt brine solutions. This electrolytic reaction produces these chemicals as co-products, and also produces hydrogen gas. The three principal commercial manufacturing processes for chlorine and sodium hydroxide are the membrane cell, the diaphragm cell and the mercury cell methods. The mercury cell process accounts for approximately 15% of the total production of chlorine and sodium hydroxide. See *Chemical and Process Technology Encyclopedia*, by McGraw-Hill, edited by Douglas M. Considine, 1974, at page 275.

All three manufacturing processes require substantial amounts of electrical energy to accomplish the reduction. In fact, depending upon local electric power availability, generally over 50% of the cost to manufacture these important industrial chemicals is attributable to energy requirements alone. Obviously, any reduction in such energy needs has a material impact on total manufacturing costs and would be an important development in this basic industry. The improvement in the process described herein represents an approximate 2% to 10% reduction in energy requirements over the older and prevailing process for a given volume of product. The significance of such a development is reflected in the amount of chlorine produced annually in this country, reportedly in excess of 10 million pounds per year (Id., at page 273).

In either the mercury cell or diaphragm cell methods, an anode and cathode are immersed in a brine solution. When a current is directed through the electrolyte, chlorine is produced at the anode (typically made of graphite) while sodium hydroxide is produced near the cathode (Id., at page 275).

Production of chlorine by the mercury cell process involves both a brine cycle and a mercury cycle, two continuous and interactive fluid cycles. The process dictates that most modern mercury cells be similar in construction and appearance with an electrolyzer section and a decomposer section to accommodate the two fluid cycles, for instance, see FIG. C-18, Id., at page 276. In the long rectangular electrolyzer section, chlorine gas forms on the anode, bubbles to the top, and is removed. Metallic sodium formed at the mercury cathode immediately amalgamates with the mercury flowing along the bottom under a gravity head. The depleted brine and mercury/sodium amalgam flow concurrently into the next equipment section, the decomposer, where deionized water is added to form sodium hydroxide and hydrogen gas, thus regenerating the mercury for recycle. The concentrated caustic solution is removed as a product. Modern cells may operate in the foregoing manner using more than 300,000 amps and a current density of over 10,000 amps per square meter at the cathode.

Important and notable differences between modern mercury cell designs are in the configuration of the decomposer section where sodium hydroxide is generated and in the technique for adjusting the anode to cathode gap in the electrolyzer section to minimize voltage drop. The voltage across the cell is directly proportional to power requirements ($P=VI$) and hence, energy consumption ($W=VIt$) [assuming a constant amperage, I, which enables production of a constant flow rate of product generated over time, t]. The anode section is typically an array of several anodes suspended from an overhead bus running across the electrolyzer above the mercury cathode. For instance, see FIG. C-19, Id., at page 277. To minimize voltage drop, the group of anodes is lowered until there is an incipient short circuit. The anodes are then raised so that the clearance under dynamic conditions is the least practical distance to obtain minimum voltage drop across the cell while allowing for reasonable anode life. Typically, the voltage will be 4.3 volts at about 10,000 amps per square meter in an ordinary modern production cell.

Side reactions at both the cathode and anode can interfere with the primary electrochemical reduction. For example, hypochlorite is a natural by-product of the reaction between chlorine (formed at the anode) and water. This reactant can erode graphite anodes and reduce the yield for a given current. See *Operating Manual for A Plant for the Electrolysis of Alkaline Chloride*, Friedrich Uhde, GmBH., at pages 21–22. Contaminants in the brine can also cause inefficiencies at the cathode. Magnesium in the feed brine can lead to magnesium hydroxide precipitation at the mercury cathode. The pH in the boundary layer near the cathode is believed to be sufficiently alkaline to cause this precipitation which tends to block the transport of sodium ions, which in turn raises the electrode resistance potential and energy consumption. See *Salt Resources and Brine Treatment in Chloralkali Production*, by J. H. G. van der Stegen, Akzo Report. 90.00.007, at pages 58–59.

In the invention, it has now been determined that by adding to the cell feed brine a small amount of water soluble polymer containing polar functional groups, the cell voltage can thereby be reduced, and consequently, overall power requirements are reduced for the same volume of chemical production. This small amount of polar polymeric compound in the feed stream is believed to inhibit the formation of interfering precipitates such as magnesium hydroxide and possibly the hydrolysis derivatives of chlorine, such as hypochlorite.

One example of such a polymeric material is polyacrylic acid in an emulsifying solution. This material, once dissolved in an aqueous medium, can be metered into the feed brine in minute amounts and effectuate an approximate 2% to 10% reduction in electrical power consumption for a given product yield as compared with the same cell conditions without the polymer present.

DETAILED DESCRIPTION OF THE PREFERRED EMBODIMENT

The brine feed to mercury cells often contains a number of contaminants. These can be introduced in the handling processes by which the brine is transported. Alternatively, these contaminants can be indigenous compounds found in the solid sodium chloride source. For instance, commercial bulk rock salt, which is the typical source of sodium chloride in the mercury cell process, is mainly produced from salt mining or dissolution from underground deposits. These deposits usually contain a significant amount of contaminating minerals, such as calcium sulfate, calcium carbonate, magnesium carbonate, silicon oxide, sodium carbonate, and many others. Iron oxide and other insoluble materials may also be present as contaminants. See Considine, at page. 994. These contaminants can be entrained or solubilized along with the sodium chloride so that the commercially available feed stocks contain about 1% to 3% impurities (Id.). These partially solubilized and entrained contaminants give rock salt solutions a cloudy appearance and often result in some fine particulate matter being suspended throughout the solution.

To remove these contaminants, polyacrylic acid is often used as a clarifying agent for the brine feed to the electrolysis cells. In such a purification process, the polymer agglomerates contaminates such as calcium carbonate into macroscopic particles which can be settled and/or filtered out of the solution before the brine is introduced into the electrolysis cell. In that way, contaminants are at least partially removed from the feed, as is the polymer which binds to the particulates. This binding of contaminants is carried out with a sand or particulate filter bed to completely remove the polymer bound trash.

In the present disclosure, which is surprisingly simple, the polymer is actually introduced immediately upstream of the cell inlet and allowed to pass directly into the cell without being filtered out. The polymer is introduced into the electrolyzer in a dilute aqueous solution. Addition can be by any mechanical means which assures a relatively constant flow rate and which maintains a reasonably constant concentration of polymer in the feed brine. A concentration of about 0.25 to about ten parts per million (ppm) of polyacrylic acid in the brine stream is highly effective, with the preferred concentration level equal to about 0.5 ppm. The concentrated water soluble polymer emulsion must first be diluted with water before it is placed into the polymer injection apparatus for easier control of the polymer stream and to prevent precipitation of the polymer when it first contacts the warm brine. Addition of the polymer emulsion concentrate directly into the brine would cause the polymer to form solid globules, but such problems are avoided by first diluting the concentrate with water.

In a typical production cell, brine is fed into the electrolyzer section at a rate of about 80 gallons per minute. Each electrolyzer is a long rectangular steel chamber with rubber lined sides, tops and end boxes. A typical production scale electrolyzer is 4 ft wide by 40 feet long. The bottom has a pitch of usually about 10 millimeters per meter to allow the mercury to flow by gravity. In plants constructed before the early to mid 1970's, graphite was the typical material for construction of the anode cylinders. Today, most cells utilize metal anodes, often simply replacing the original style graphite anodes of older plants. The metal anodes are usually made from titanium and have an oxide coating such as ruthenium oxide. The process disclosed herein can be used with both the older graphite anodes and the modern metal anode configuration.

In a typical application using metal anodes, one pound of polyacrylic acid emulsion is first dissolved in 25 gallons of water and thoroughly mixed. This dilute polymer solution is then metered directly into the feed brine stream immediately upstream of the electrolyzer inlet. Introduction of only 25 ml per minute, or 0.5 ppm, of diluted polymer solution into the brine feed can reduce cell voltage approximately 8% and the reduction occurs almost immediately. Lower cell voltages at constant current flows are maintainable by allowing the anode to cathode gap to be reduced. The polymer results in no noticeable ill effects.

It is believed that the presence of the polar polymer in the electrolyte inhibits magnesium hydroxide formation at the mercury cathode and possibly inhibits hydrolysis of the chlorine at the anode. The polymer may also have some type of chelating property by which it alters the usual chemical reactivity of trace ions in the electrolyte or somehow inhibits their transport thorough the solution. No matter the actual mechanism, cell voltages are significantly lowered by the presence of trace amounts of polymer, resulting in a corresponding power consumption savings.

EXAMPLES

In order to more fully illustrate the present invention, the following non-limiting examples are presented. In examples A through C, the following procedure was employed in a modern production scale mercury cell with metal Eltech DSA anodes the Eltech firm is the manufacturer of the metal anodes sold under the trademark DSA. Generally, this electrode has the form of a set of a parallel closely spaced slats formed of metal where the spaces between adjacent slats permit fluid flow. This metal anode is normally used in a submerged state. Moreover, it provides an enlarged surface area in light of the fact that gas liberation occurs at the metal/-liquid interface when the metal anode is placed in the solution within the electrochemical cell. Steady state flow of sodium chloride brine was established to the mercury cells and a constant current flow maintained. The brine was first clarified by settling and sand bed filtering to remove contaminants. Individual cells in a production plant containing 52 cells were chosen for the test. In all test cells, the anode to mercury cathode gap was first minimized so that the minimum cell voltage was achieved. At no time, however, was cell voltage allowed to decrease below 4.05 volts, the minimum necessary to avoid possible side reactions and drive the main desired reaction. The cell voltage was recorded at steady state conditions before the addition of polymer solution.

The polymer solution was prepared as a batch mixture using a given weight of polyacrylic acid concentrate mixed with 25 gallons of ordinary water. The polymer concentrate was diluted for ease of handling and to prevent precipitation upon initial contact with brine. The polyacrylic acid concentrate was a proprietary solution of polyacrylic acid in 20–30% emulsifying oil. This product, known as Polymer 1131L, was obtained from Betz Industrial and is normally used as a flocculant in brine clarification. The product is an opaque, off-white liquid with a viscosity of 532 centipoise at 70 degrees Fahrenheit and a specific gravity of 1.063. The amount of polyacrylic acid used was selected to achieve a given concentration of polymer in the steady state flow of feed brine.

The polyacrylic acid solution was metered into the feed brine with a constant flow apparatus at a constant rate of between 25 and 100 milliliters per minute, depending on the test. Cell voltages were typically recorded over a 24 hour period and all other conditions before the addition of polymer were maintained the same.

EXAMPLE A

In this test, conducted in cell no. 35, one pound of polyacrylic acid emulsion was added to 25 gallons of water and thoroughly mixed. This polymer solution was metered into the cell feed brine at a rate of 50 milliliters per minute, which resulted in a concentration of 1 ppm of polymer. The steady state voltage across the cell before polymer addition was 4.28 volts, the minimum achievable by anode to cathode gap adjustment. After 4 hours of metering in polymer at a rate to maintain a 1 ppm concentration, the cell voltage dropped to 4.08 volts with all other conditions kept the same. No problems were encountered and product purity was not altered.

EXAMPLE B

In this test, conducted in cell no. 46, one pound of polyacrylic acid emulsion was added to 25 gallons of water and thoroughly mixed. This polymer solution was metered into the cell feed brine at a rate of 25 milliliters per minute, which resulted in a concentration of 0.5 ppm of polymer. The steady state voltage across the cell before polymer addition was 4.38 volts, the minimum achievable by anode to cathode gap adjustment. After 2 hours of metering in polymer at a rate to maintain a 0.5 ppm concentration, the cell voltage dropped to 4.18 volts with all other conditions kept the same. After lowering the anodes to minimize the gap above the cathode, the cell voltage was reduced to 4.05 volts, the minimum practical voltage. After running in this manner for over 8 hours, polymer addition was stopped, and shortly thereafter, the cell began to short. When polymer addition was restarted at the same concentration of 0.5 ppm, the voltage dropped back down to 4.05 volts.

EXAMPLE C

In this test, conducted in cell no. 40, one half pound of polyacrylic acid emulsion was added to 25 gallons of water and thoroughly mixed. This polymer solution was metered into the cell feed brine at a rate of 25 milliliters per minute, which resulted in a concentration of 0.25 ppm of polymer. After one hour, there was no noticeable effect. The steady state voltage across the cell before polymer addition was 4.32 volts, the minimum achievable by adjusting the anode to cathode gap. After one hour of no change at 0.25 ppm, the polymer flow rate was increased to 50 milliliters per minute, equivalent to a concentration of 0.5 ppm. After one hour of metering the polymer at a rate to maintain a 0.5 ppm concentration of polymer, the cell voltage dropped to 4.09 volts with all other conditions kept the same.

While the foregoing is directed to the preferred embodiment, the scope thereof is determined by the claims which follow.

What is claimed is:

1. A process for producing chlorine, sodium hydroxide and hydrogen from sodium chloride brine by electrolysis in a mercury cell in which a quantity of dilute solution of a water soluble polar polymer in an emulsifying medium and water is added at a selected rate to the brine which is introduced into an electrolytic cell in order to reduce the cell voltage.

2. A process in accordance with claim 1 in which the water soluble polar polymer in the emulsifying medium contains anionic functional groups.

3. A process in accordance with claim 1 in which the water soluble polar polymer in the emulsifying medium is polyacrylic acid.

4. A process in accordance with claim 3 in which the polyacrylic acid concentration in the brine is in the range of about 0.25 ppm to about 10 ppm.

5. A process in accordance with claim 3 in which the polyacrylic acid concentration in the brine is about 0.5 ppm to about 1.0 ppm.

6. The process of claim 5 wherein the polar polymer is added to the process upstream of the mercury cell.

7. The process of claim 6 wherein brine is added to the mercury cell in continuous flow, and the mercury is circulated in the cell.

8. The process of claim 7 wherein brine added to the cell carries the polar polymer flow into the cell.

* * * * *